US009131574B2

(12) United States Patent
Chang et al.

(10) Patent No.: US 9,131,574 B2
(45) Date of Patent: Sep. 8, 2015

(54) DUAL-PURPOSE LAMP

(71) Applicant: GUNITECH CORP., Hsinchu County (TW)

(72) Inventors: Wen-Hsin Chang, Hsinchu County (TW); Jiun-Hua Yang, Hsinchu County (TW); Chien-Ju Hung, Hsinchu County (TW); Enoch Zhao, Hsinchu County (TW); Po-Kuei Chou, Hsinchu County (TW)

(73) Assignee: Gunitech Cop., Hsinchu County (TW)

( * ) Notice: Subject to any disclaimer, the term of this patent is extended or adjusted under 35 U.S.C. 154(b) by 92 days.

(21) Appl. No.: 14/017,363

(22) Filed: Sep. 4, 2013

(65) Prior Publication Data

US 2015/0015163 A1 Jan. 15, 2015

(30) Foreign Application Priority Data

Jul. 11, 2013 (TW) ..... 102213168 U

(51) Int. Cl.
*H05B 33/08* (2006.01)
*H05B 37/00* (2006.01)

(52) U.S. Cl.
CPC ..... *H05B 33/0845* (2013.01); *H05B 33/0824* (2013.01)

(58) Field of Classification Search
None
See application file for complete search history.

(56) References Cited

U.S. PATENT DOCUMENTS

2008/0001547 A1* 1/2008 Negru ..... 315/189
2013/0154484 A1 6/2013 Xu

FOREIGN PATENT DOCUMENTS

WO WO2008157772 A1 12/2008

OTHER PUBLICATIONS

Yates, D. "20-Led Display from a 10-Led DVM", Electronics World + Wireless World, Jan. 1, 1991, p. 28, vol. 97, No. 1659, Sutton, Surrey, Great Britain.

* cited by examiner

*Primary Examiner* — Douglas W Owens
*Assistant Examiner* — Dedei K Hammond
(74) *Attorney, Agent, or Firm* — Alan D. Kamrath; Kamrath IP Lawfirm, P.A.

(57) ABSTRACT

A dual-purpose lamp includes a power-converting module, a light-emitting module and a control unit. The power-converting module is used for generating a direct current. The light-emitting module is electrically connected with the power-converting module. The light-emitting module includes an illuminative light-emitting body and a scenario light-emitting body, and the illuminative light-emitting body and the scenario light-emitting body are connected with each other in parallel. The control unit is electrically connected with the power-converting module and is used for controlling the power-converting module to adjust the brightness of the illuminative light-emitting body when light is emitted, or to adjust the color, the brightness or the chroma of the scenario light-emitting body when light is emitted.

6 Claims, 7 Drawing Sheets

DUAL-PURPOSE LAMP

FIELD

The exemplary embodiments of the present invention relate to a dual-purpose lamp. More specifically, the exemplary embodiments of the present invention relate to a dual-purpose lamp that can provide multiple illuminating functions.

BACKGROUND

As the light-emitting diode (LED) is becoming more and more common, most recent illumination apparatuses use the LED as a light source. The illuminating functions of the lamp on the market nowadays are quite limited. A lamp having two purposes can emit only white light and yellow light for general illumination and for night illumination. Regardless of whether a lamp is used for general illumination or night illumination, the color, brightness, and the chroma of the emitted light cannot be changed, so the functions of traditional lamps are quite limited.

SUMMARY

The main object of the present invention is to provide a dual-purpose lamp that can provide multiple illuminating functions.

In order to achieve the aforementioned object, the dual-purpose lamp of the present invention comprises a power-converting module, a light-emitting module and a control unit. The power-converting module is used for generating a direct current. The light-emitting module is electrically connected with the power-converting module. The light-emitting module comprises an illuminative light-emitting body and a scenario light-emitting body, and the illuminative light-emitting body and the scenario light-emitting body are connected with each other in parallel. The control unit is electrically connected with the power-converting module and is used for controlling the power-converting module to adjust the brightness of the illuminative light-emitting body when light is being emitted, and it is also used to adjust the color, the brightness, or the chroma of the scenario light-emitting body when light is emitted.

According to one embodiment of the present invention, the control unit of the present invention is used for generating a pulse controlling signal. The pulse controlling signal is used for controlling a working period for which the power-converting module outputs the direct current to the light-emitting module. By controlling the working period, the control unit controls the illuminative light-emitting body to emit light or not and adjusts the brightness of the illuminative light-emitting body when light is emitted, or it controls the scenario light-emitting body to emit light or not and adjusts the color, the brightness, or the chroma of the scenario light-emitting body when light is emitted.

According to one embodiment of the present invention, the dual-purpose lamp further comprises a plurality of switch devices. Each switch device is connected respectively with the illuminative light-emitting body and the scenario light-emitting body in series, and each switch device is used for making the illuminative light-emitting body or the scenario light-emitting body emit light or not.

According to one embodiment of the present invention, the dual-purpose lamp further comprises a plurality of flip flops. Each flip flop has a first end and a second end. The first end of each flip flop is electrically connected with a switch device connected to the illuminative light-emitting body, and the second end of each flip flop is electrically connected with a switch device connected to the scenario light-emitting body.

According to one embodiment of the present invention, the control unit of the present invention is electrically connected with each switch device, and the control unit is further used for controlling each switch device to make the illuminative light-emitting body or the scenario light-emitting body emit light or not.

According to one embodiment of the present invention, the illuminative light-emitting body of the present invention comprises a plurality of white LEDs, and the scenario light-emitting body comprises a red LED, a green LED and a blue LED.

BRIEF DESCRIPTION OF THE DRAWINGS

The exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

For facilitating understanding and clarifying the object, characteristics and advantages of the present invention, the following specific embodiments and figures of the present invention are presented to provide a detailed description.

Figure 1:
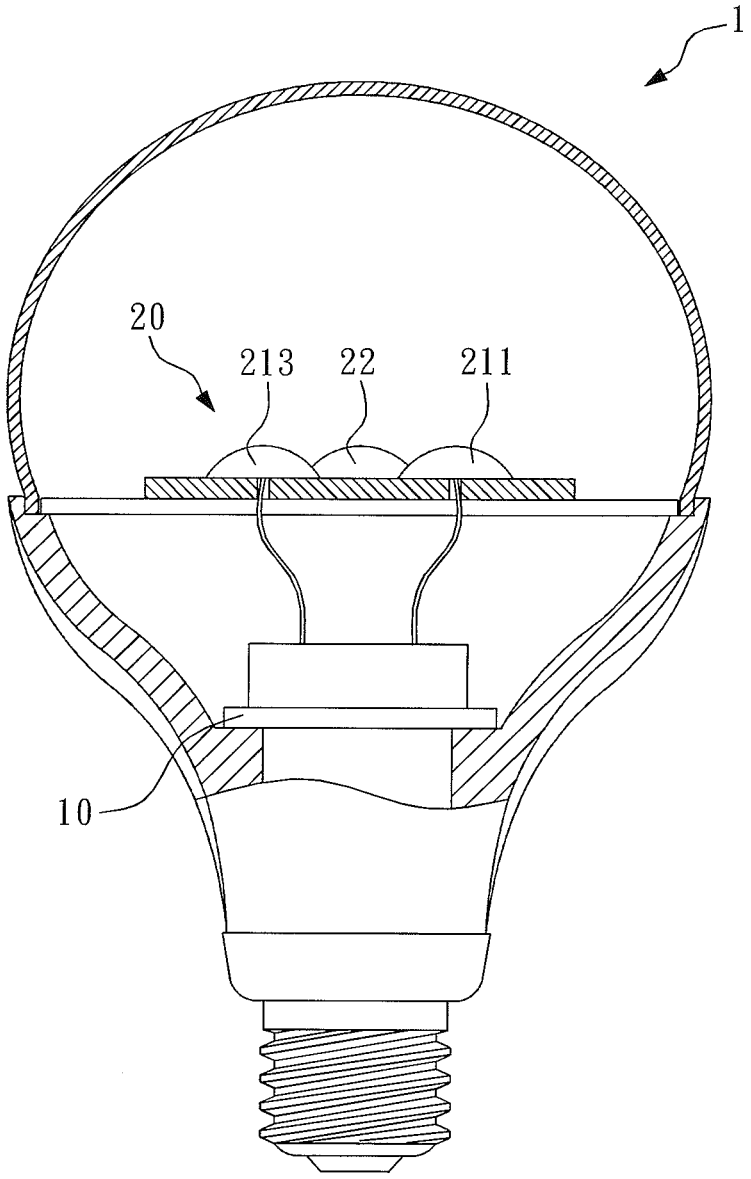
FIG. 1 is an external appearance schematic diagram of the dual-purpose lamp in accordance with the present invention.
Figure 2:
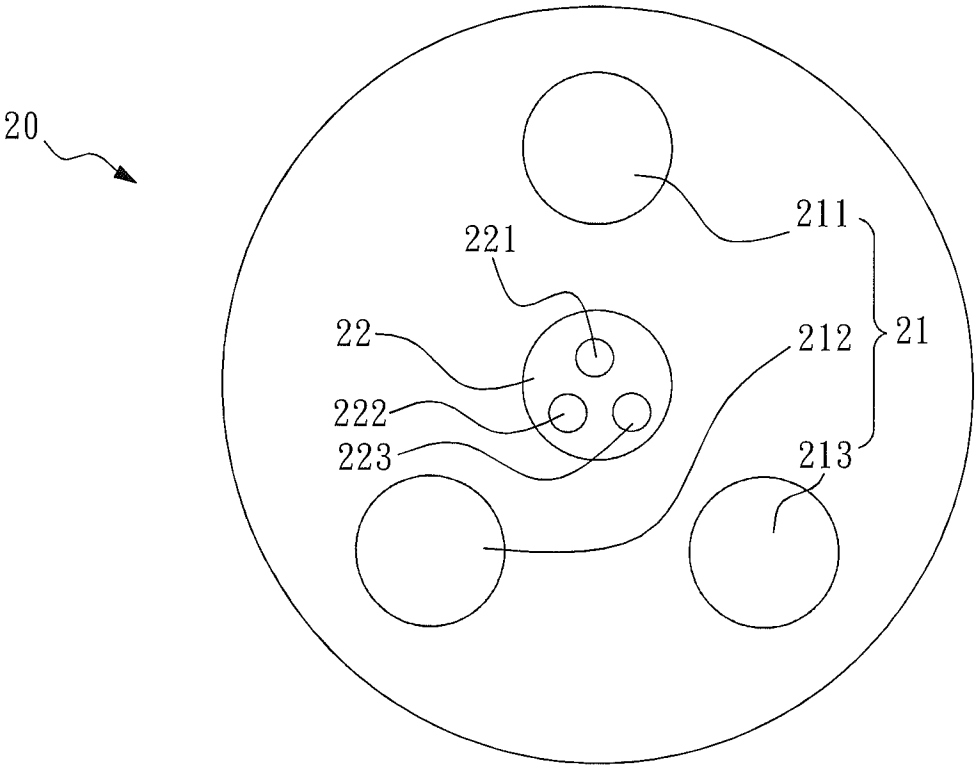
FIG. 2 is a top-view diagram of the light-emitting module of the dual-purpose lamp in accordance with the present invention.
Figure 3:
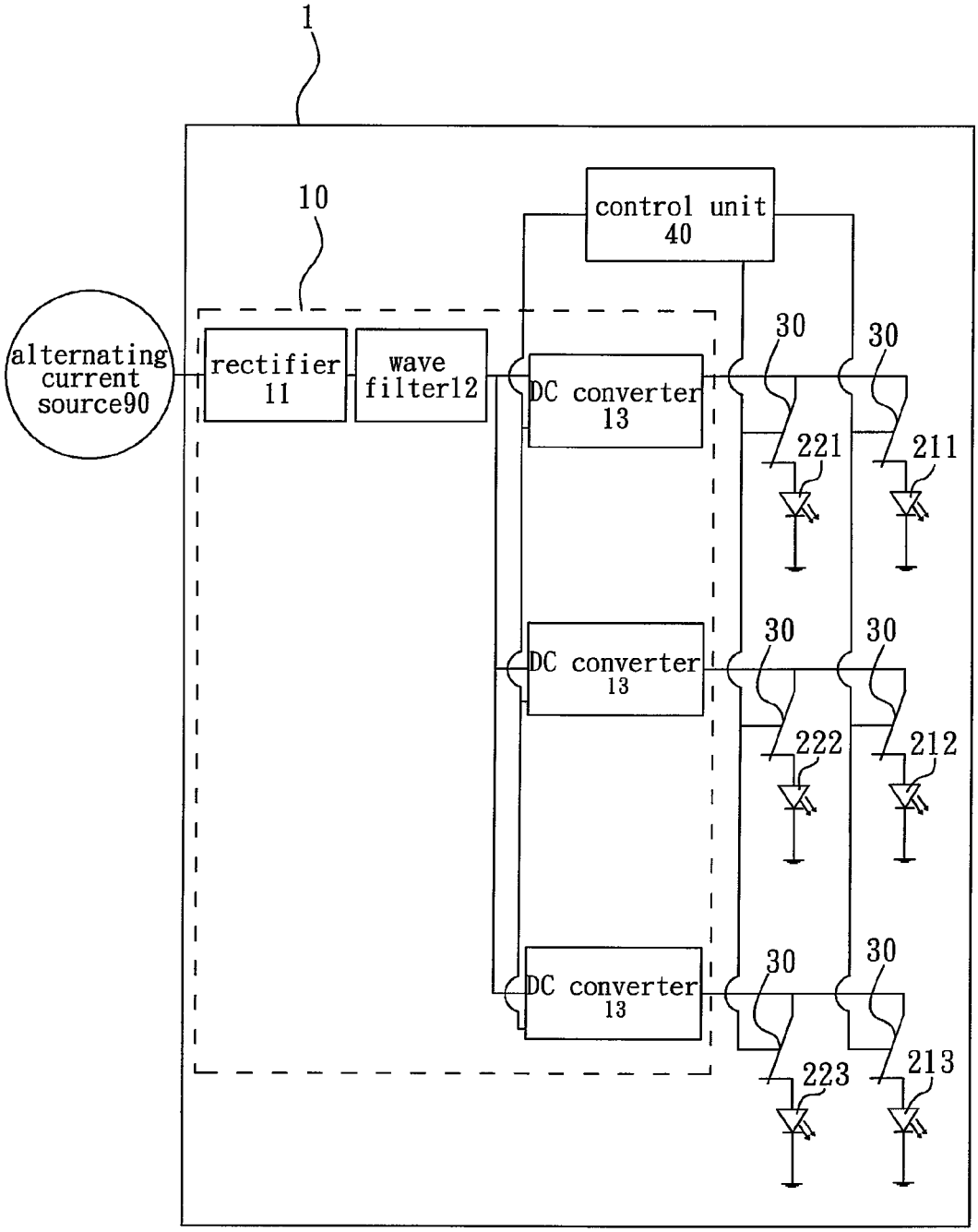
FIG. 3 is a structure schematic diagram of the first embodiment of the dual-purpose lamp in accordance with the present invention.

First please refer to FIG. 1 to FIG. 3 together, which are the structure schematic diagrams related to the first embodiment of the dual-purpose lamp in accordance with the present invention.

As shown in FIG. 1 and FIG. 3, the dual-purpose lamp 1 of the present invention is electrically connected with an alternating current source 90. The alternating current source 90 is used for providing power to the dual-purpose lamp 1. In the first embodiment of the present invention, the dual-purpose lamp 1 of the present invention comprises a power-converting module 10, a light-emitting module 20, a plurality of switch devices 30 and a control unit 40.

The power-converting module 10 is electrically connected with the alternating current source 90. In the first embodiment of the present invention, the power-converting module 10 includes a rectifier 11, a wave filter 12 and a plurality of DC converters 13. The rectifier 11 is used for converting the alternating current generated by the alternating current source 90 into direct current. The wave filter 12 is electrically connected with the rectifier 11, and the wave filter 12 is used for filtering the noise of the electronic signal. The plurality of DC converters 13 is connected with the wave filter 12 in series, and the DC converters 13 are connected with one another in parallel. Each DC converter 13 is used for generating a stable direct current. Since the aforementioned devices are well known, those skilled in the art are familiar with the circuit structure and the theory, and, thus, no further description will be provided here.

As shown in FIG. 1, the light-emitting module 20 is electrically connected with the power-converting module 10. As shown in FIG. 2 and FIG. 3, in the first embodiment of the present invention, the light-emitting module 20 comprises an illuminative light-emitting body 21 and a scenario light-emitting body 22. The illuminative light-emitting body 21 connects with the scenario light-emitting body 22 in parallel. In the embodiment of the present invention, the illuminative light-emitting body 21 comprises a plurality of white LEDs 211, 212 and 213. All white LEDs 211, 212 and 213 are connected with the others in parallel and are used for emitting white light. The scenario light-emitting body 22 comprises a red LED 221, a green LED 222 and a blue LED 223, and all three of which are also connected with each other in parallel, such that the scenario light-emitting body 22 can emit red light, green light, blue light, or light of other colors by mixing the light of the aforementioned three colors. However, the illuminative light-emitting body 21 and the scenario light-emitting body 22 of the present invention are not limited to the aforementioned examples. For example, the scenario light-emitting body 22 can also comprise a white LED.

As shown in FIG. 3, in the first embodiment of the present invention, the plurality of switch devices 30 is connected with the white LEDs 211, 212, 213 of the illuminative light-emitting body 21, the red LED 221, the green LED 222 and the blue LED 223 of the scenario light-emitting body 22 in series. Each switch device 30 is used for enabling or cutting off the current path flowing through the LEDs, and, thus, each LED is controlled to emit light or not by the switch device 30 enabling or cutting off.

In the first embodiment of the present invention, the control unit 40 is electrically connected with the power-converting module 10 and the plurality of switch devices 30. The control unit 40 is used for controlling each switch device 30 to be enabled or disabled to control the illuminative light-emitting body 21 or the scenario light-emitting body 22 to emit light or not. The control unit 40 is further used for generating a pulse controlling signal, such that the control unit 40 controls a working period for which each DC converter 13 of the power-converting module 10 outputs the direct current to the light-emitting module 20 by the pulse controlling signal with the functions of adjusting the brightness of the illuminative light-emitting body, or adjusting the color, the brightness or the chroma of the scenario light-emitting body through adjusting the working period. It has to be noted here that in the present embodiment, each switch device 30 is controlled by the control unit 40, but control of the switch devices 30 is not limited only to the control unit 40. The switch device 30 can also be controlled by mechanical button switches or electronic switches. In the specific embodiment of the present invention, the control unit 40 can be a Microcontroller Unit (MCU), but the present invention is not limited therein. Since Pulse Width Modulation is a well-known technique, and since those skilled in the art can easily understand how to control the brightness of the LED when light is emitted by controlling the working period for which a constant current is output, no further description will be provided here.

As shown in FIG. 3, when a user turns on the illuminative light-emitting body 21, i.e., when the user enables the switch devices 30 connected to each white LED 211, 212, 213 in series, the lamp will enter an illuminating mode, which is used by the user for normal illumination. Under the illuminating mode, the user can control the brightness of the illuminative light-emitting body 21 when light is emitted by adjusting the working period of the DC converter 13 outputting the direct current based on the brightness demand of the user. On the other hand, when the user turns on the scenario light-emitting body 22, i.e., when the user enables the switch devices 30 connected to the red LED 221, the green LED 222 or the blue LED 223, the lamp will enter a scenario mode. In the scenario mode, the user can control the color, the brightness or the chroma of the scenario light-emitting body 22 when light is emitted by adjusting the working period of the DC converter 13 outputting the direct current based on the scenario demand of the user. For example, the user can control the scenario light-emitting body 22 to emit red-blue light for possible health benefits.

Figure 4:
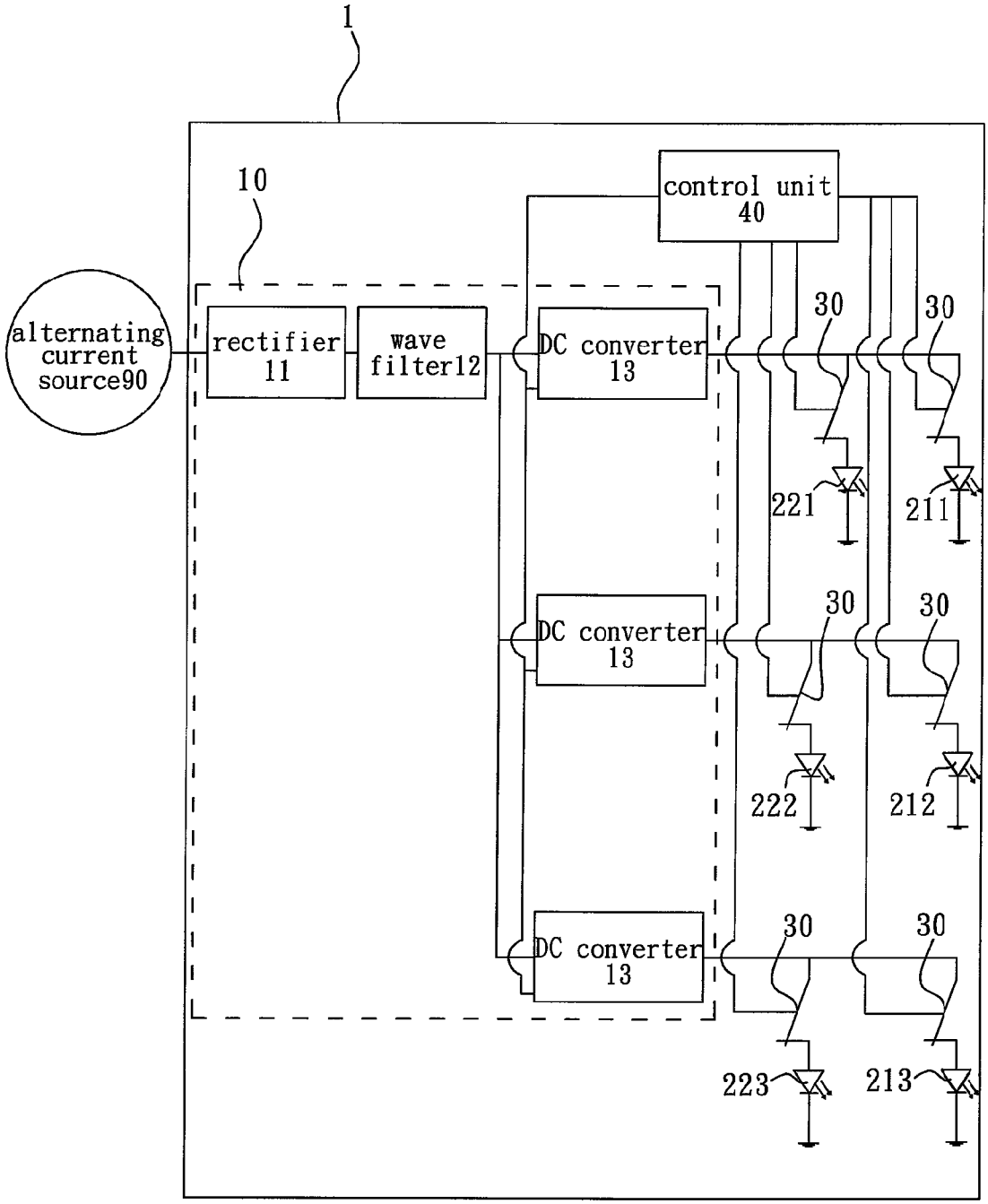
FIG. 4 is a structure schematic diagram of the second embodiment of the dual-purpose lamp in accordance with the present invention.

Next please refer to FIG. 4, which is a structure schematic diagram of the second embodiment of the dual-purpose lamp in accordance with the present invention, and please refer to FIG. 2 concurrently.

As shown in FIG. 2 and FIG. 4, the second embodiment of the present invention differs from the first embodiment in that the user can independently control any one of the LEDs in the illuminative light-emitting body 21 or the scenario light-emitting body 22 to emit light or not, thus reducing the power consumption of the lamp during use.

Figure 5:
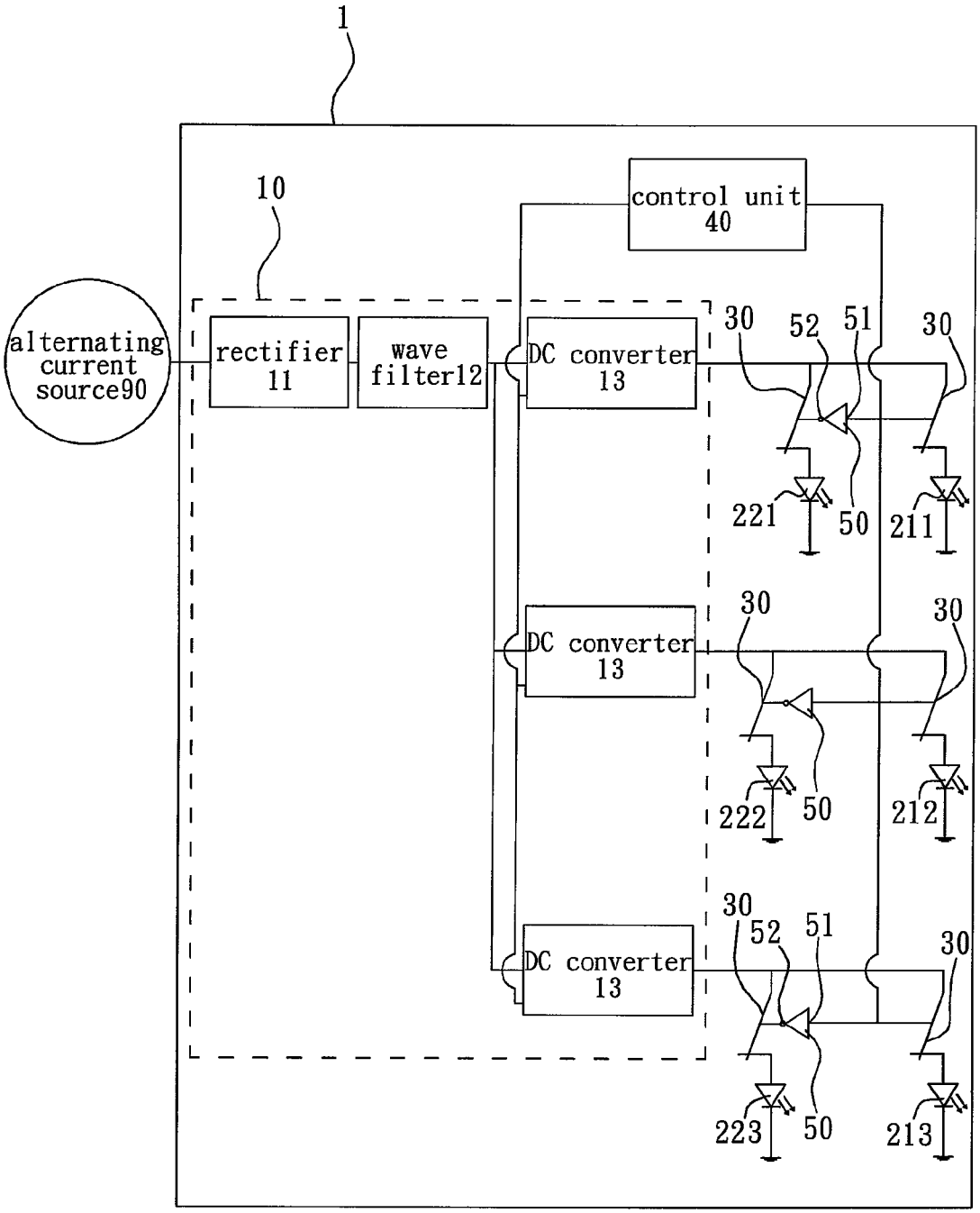
FIG. 5 is a structure schematic diagram of the third embodiment of the dual-purpose lamp in accordance with the present invention.

Next please refer to FIG. 5, which is a structure schematic diagram of the third embodiment of the dual-purpose lamp in accordance with the present invention, and please refer to FIG. 2 concurrently.

As shown in FIG. 2 and FIG. 5, in the third embodiment of the present invention, the dual-purpose lamp 1 further comprises a plurality of flip flops 50. Each flip flop 50 has a first end 51 and a second end 52. The first end 51 of each flip flop 50 is electrically connected with a switch device 30 connected with the illuminative light-emitting body 21 in series, and the second end 52 of each flip flop 50 is electrically connected with a switch device 30 connected with the scenario light-emitting body 22 in series.

In practice, for the aforementioned third embodiment of the circuit, assume that each switch device 30 is enabled when the input signal is at a high level and disabled when the input signal is at a low level (i.e., 1 on, 0 off). Then, if the user wants the lamp turned on in illuminating mode, inputting a high level signal (input 1) through the control unit 40 will enable each switch device 30 connected with the white LEDs 211, 212, 213 in series, and, thus, the white LEDs 211, 212, 213 will emit light. At the same time, the high level signal will be converted into a low level signal (1 to 0), processed and output by the flip flop 50, and the switch devices 30 connected with the red LED 221, the green LED 222 and the blue LED 223 in series will not be enabled due to the inputting of the low level signal, so the scenario light-emitting body 22 will not emit light. Therefore, the user can switch between the illuminative light-emitting body 21 and the scenario light-emitting body 22 with only a single controlling signal.

Figure 6:
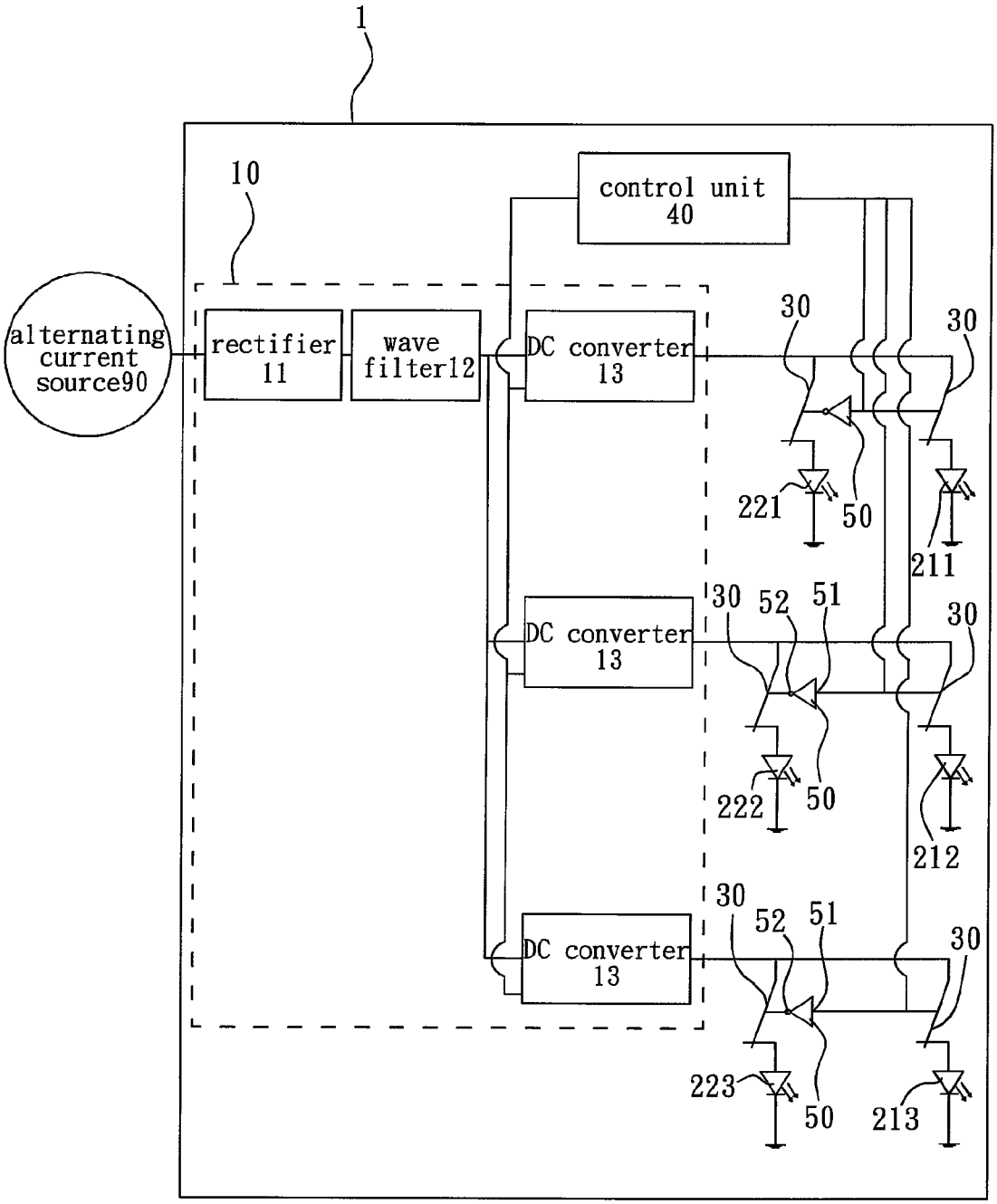
FIG. 6 is a structure schematic diagram of the fourth embodiment of the dual-purpose lamp in accordance with the present invention.

Next please refer to FIG. 6, which is a structure schematic diagram of the fourth embodiment of the dual-purpose lamp in accordance with the present invention, and please refer to FIG. 2 concurrently.

As shown in FIG. 2 and FIG. 6, the fourth embodiment of the present invention differs from the aforementioned third embodiment in that the user can individually control each white LED 211, 212, 213 in the illuminative light-emitting body 21 and each of the LEDs in the scenario light-emitting body 22 to emit light or not. In addition, when the switch device 30 connected with the first end 51 of a flip flop 50 is turned on via the controlling signal, the switch device 30 connected with the second end 52 of the same flip flop 50 will be disabled.

Figure 7:
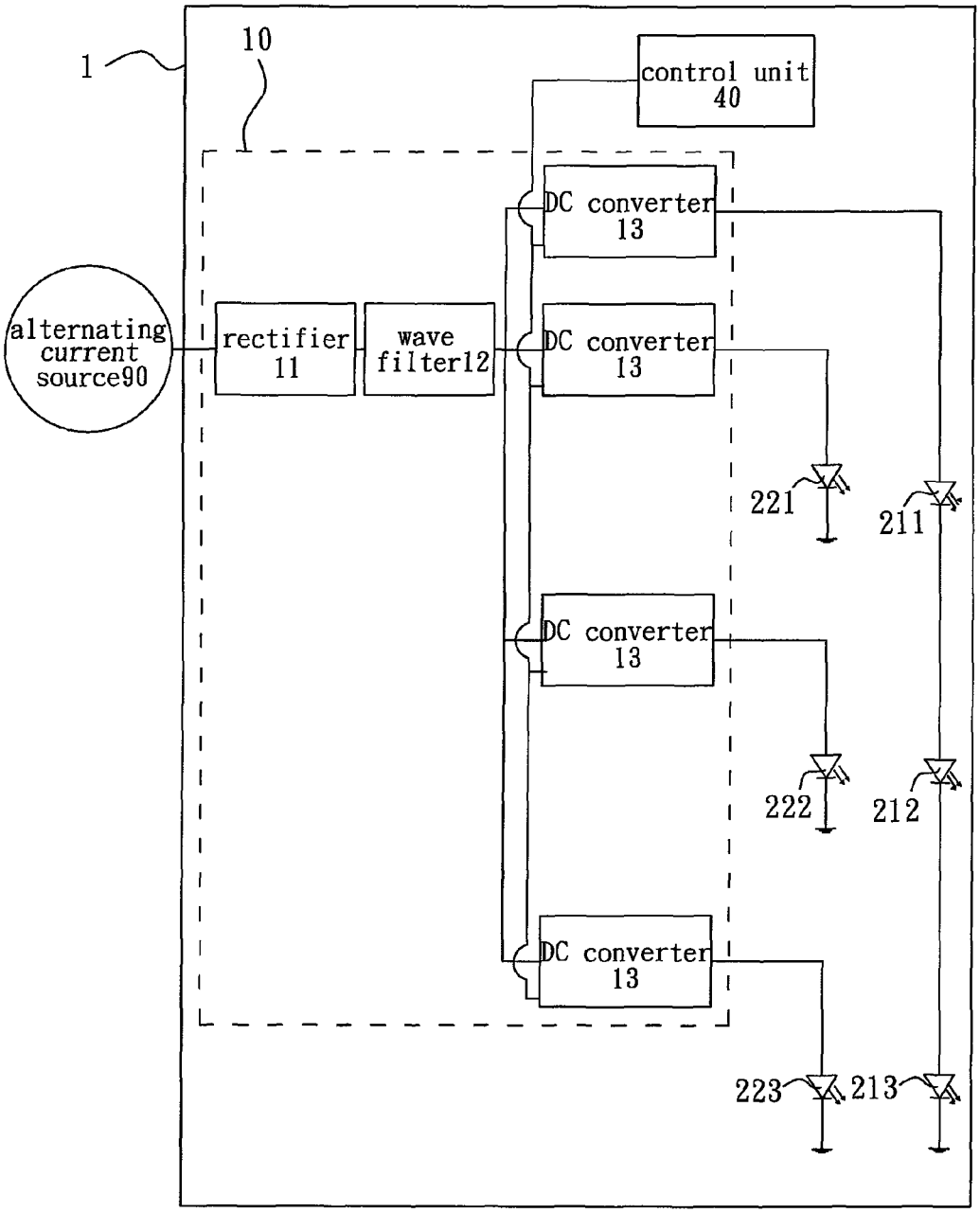
FIG. 7 is a structure schematic diagram of the fifth embodiment of the dual-purpose lamp in accordance with the present invention.

Finally, please refer to FIG. 7, which is a structure schematic diagram of the fifth embodiment of the dual-purpose lamp in accordance with the present invention, and please refer to FIG. 2 concurrently.

As shown in FIG. 7, in the fifth embodiment of the present invention, the dual-purpose lamp 1 of the present invention comprises a power-converting module 10, a light-emitting module 20 and a control unit 40. In other words, the present embodiment differs from the aforementioned embodiments in that the dual-purpose lamp 1 does not use the switch device 30 but controls the illuminative light-emitting body 21 or the scenario light-emitting body 22 to emit light or not, and adjusts the brightness of the illuminative light-emitting body 21 when light is emitted, or adjusts the color, the brightness or the chroma of the scenario light-emitting body 22 when light is emitted, by controlling the working period for which each DC converter 13 outputs the direct current to the light-emitting module 20. For example, the control unit 40 can control the working period of the DC converter 13 outputting direct current to the red LED 221 to be less than 0.1%. At this time, due to the very short light emitting period of the red LED 221, visually it will seem that the red LED 221 is turned off. Furthermore, if the working period for which the DC converter 13 outputs current to the blue LED 223 is increased from 20% to 50%, the brightness of the blue LED 223 will be increased.

In summary, regardless of the function, the way and result of the present invention are shown to have technical characteristics different from those of the prior arts. However, the aforementioned embodiments are intended only for illustrating the principle and the result of the present invention and not for limiting the range of the present invention. It will be obvious to those skilled in the art that, based upon the descriptions herein, changes and modifications may be made without departing from this invention and its broader aspects. Therefore, the appended claims are intended to encompass within their scope all such changes and modifications as are within the true spirit and scope of the exemplary embodiments of the present invention.

What is claimed is:

1. A dual-purpose lamp comprising:

a power-converting module used for generating a direct current;

a light-emitting module electrically connected with the power-converting module, with the light-emitting module comprising an illuminative light-emitting body and a scenario light-emitting body, and with the illuminative light-emitting body and the scenario light-emitting body connected with each other in parallel;

a control unit, electrically connected with the power-converting module, used for controlling the power-converting module to adjust the brightness of the illuminative light-emitting body when light is emitted, or to adjust the color, the brightness or the chroma of the scenario light-emitting body when light is emitted;

a plurality of switch devices, with each switch device connected respectively with the illuminative light-emitting body and the scenario light-emitting body in series, and with each switch device used for making the illuminative light-emitting body or the scenario light-emitting body emit light or not; and a plurality of flip flops, with each flip flop having a first end and a second end, with the first end of each flip flop electrically connected with a corresponding switch device connected to the illuminative light-emitting body, and with the second end of each flip flop electrically connected with a corresponding switch device connected to the scenario light-emitting body.

2. The dual-purpose lamp as claim 1, wherein the control unit is used for generating a pulse controlling signal, wherein the pulse controlling signal is used for controlling a working period for which the power-converting module outputs the direct current to the light-emitting module, and wherein through the controlling of the working period, the control unit controls the illuminative light-emitting body to emit light or not and adjusts the brightness of the illuminative light-emitting body when light is emitted, or controls the scenario light-emitting body to emit light or not and adjusts the color, the brightness or the chroma of the scenario light-emitting body when light is emitted.

3. The dual-purpose lamp as claim 2, wherein the illuminative light-emitting body comprises a plurality of white LEDs, and wherein the scenario light-emitting body comprises a red LED, a green LED and a blue LED or the combination of a plurality of red/green/blue LEDs.

4. The dual-purpose lamp as claim 1, wherein the control unit is electrically connected with each switch device, and wherein the control unit is further used for controlling each switch device to make the illuminative light-emitting body or the scenario light-emitting body emit light or not.

5. The dual-purpose lamp as claim 4, wherein the illuminative light-emitting body comprises a plurality of white LEDs, and wherein the scenario light-emitting body comprises a red LED, a green LED and a blue LED or the combination of a plurality of red/green/blue LEDs.

6. The dual-purpose lamp as claim 1, wherein the illuminative light-emitting body comprises a plurality of white LEDs, and wherein the scenario light-emitting body comprises a red LED, a green LED and a blue LED or the combination of a plurality of red/green/blue LEDs.

* * * * *